US006289711B1

(12) United States Patent
Garth

(10) Patent No.: US 6,289,711 B1
(45) Date of Patent: Sep. 18, 2001

(54) METHOD AND DEVICE FOR ROUNDING BUSHINGS

(75) Inventor: Harald Garth, Munich (DE)

(73) Assignee: Krauss-Maffei AG, München (DE)

( * ) Notice: Subject to any disclaimer, the term of this patent is extended or adjusted under 35 U.S.C. 154(b) by 0 days.

(21) Appl. No.: 09/464,803

(22) Filed: Dec. 17, 1999

Related U.S. Application Data

(62) Continuation of application No. 09/305,913, filed on May 5, 1999, now abandoned, which is a continuation of application No. 09/097,183, filed on Jun. 12, 1998, now abandoned, which is a continuation of application No. 08/737,636, filed as application No. PCT/EP96/01172 on Mar. 19, 1996, now abandoned.

(30) Foreign Application Priority Data

Mar. 25, 1995 (DE) ..... 195 11 095

(51) Int. Cl.[7] ..... B21D 53/10
(52) U.S. Cl. ..... 72/398; 29/898.057
(58) Field of Search ..... 72/403, 398, 51; 29/898.057

(56) References Cited

U.S. PATENT DOCUMENTS 2,066,025 * 12/1936 Zublin et al. ..... 72/403
3,039,187 * 6/1962 Kennedy ..... 72/403
4,370,788 * 2/1983 Baker ..... 72/398
4,395,900 * 8/1983 Saureman ..... 72/398

* cited by examiner

*Primary Examiner*—Lowell A. Larson
(74) *Attorney, Agent, or Firm*—Henry M. Feiereisen; Ursula B. Day

(57) ABSTRACT

The invention concerns a bending device (10) comprising two shaping dies (12, 14) with shaping chambers (22, 24) in order to round a sheet bar (26) about a core (16). The peripheral lengths of the two shaping chambers (22, 24) are each longer than half the bushing circumference. During a pre-shaping step, the core (16) penetrates a first chamber (22) by a depth which is greater than the bushing radius. The sheet bar (26) is thus shaped in the form of a U. In an intermediate shaping stage, an auxiliary core (18) is placed on the core (16) such that, as the second shaping die (14) moves downwards, only the end of the U-legs of the sheet bar blank (26) are shaped arcuately. When the auxiliary core (18) and part (20) of the first shaping die (12) have been removed, the final bushing shaping process occurs, in which the second shaping die (14) likewise travels over the center of the bushing. The three-stage bending method enables a bushing to be rounded highly accurately and carefully.

14 Claims, 2 Drawing Sheets

METHOD AND DEVICE FOR ROUNDING BUSHINGS

CROSS-REFERENCES TO RELATED APPLICATIONS

This application is a continuation of prior filed application Ser. No. 09/305,913 filed May 5, 1999, now abandoned, which is a continuation of prior filed patent application Appl. Ser. No. 09/097,183, filed Jun. 12, 1998 now abandoned, which is a continuation of prior filed patent application Appl. Ser. No. 08/737,636, filed Nov. 15, 1996, now abandoned, which was the National Stage of International Appl. No. PCT/EP 96/01172, filed Mar. 19, 1996.

BACKGROUND OF THE INVENTION

The invention relates to a method for rounding bushings wherein a sheet bar is inserted into a clearance between a core and a first shaping die having a first shaping chamber with an inner profile which at least approximately complements the outer profile of the bushing and which extends over at least half of the circumference of the bushing, that the sheet bar is bent approximately in the form of a U through relative movement of the core into the first shaping chamber during a pre-shaping step, that the core penetrated into the first shaping chamber shapes both legs of the U-shaped formed body in a final shaping step to a bushing through relative movement into a second shaping chamber of a second shaping die, and that the edges of both shaping chambers of both shaping dies terminate in parallel end face planes of the shaping dies, with these end face planes at least approximately contacting each other when the two shaping chambers are closed.

A method of this type is known. Most round housings, bushings and bearing sleeves are bent in this fashion from pre-stamped sheet bars; however, the result after the final shaping step is unsatisfactory, mainly because rounding is incomplete in the vicinity of the end face planes of the shaping dies. Irregularities are also observed at the bushing ends. In most cases, it is therefore necessary to finish the bushings thereafter by a sizing process. It is also impossible to avoid polishing marks on the bushing surfaces with the known methods, and high-quality materials, e.g. materials having multiple layers, plastic-coated sheet bars and the like, cannot be processed by this method without all 10 introducing surface damage.

SUMMARY OF THE INVENTION

It is an object of the present invention to provide a method and device for carrying out the method, by which the sheet bars can be rounded more accurately than previously known and this bending can be executed in more gentler fashion, so that even more delicate materials can be processed.

In most applications, rounding refers to the bending of rotationally symmetrical objects, such as cylindrical or conical bushings, but is not restricted thereto. The bent components may also have oval, elliptical, drop-shaped or similar cross-sections.

This object, and others which will become apparent hereinafter, is attained by a method of the aforementioned type in accordance with the invention by having the core penetrate the first shaping chamber by a depth which is greater than the bushing radius, so that the bushing axis lies after the pre-shaping step at a distance from the end face plane of the shaping die within the first shaping chamber.

In a further development of the invention, the core penetrates the second shaping chamber by a depth which is greater than the bushing radius so that the bushing axis, after the final shaping of the bushing, lies at a distance from the end face plane of the second shaping die within the second shaping chamber.

As the bushing center of preferably both shaping dies is respectively passed by their end faces, the rounding of the bushing is significantly improved in the 90° region and in the 270° region compared to known bending methods in which the shaping dies respectively travel precisely to the center plane of the bushing. In order to implement this method, the cross-section of at least the core, preferably however also of the first shaping die must be changed between the pre-shaping step and the final shaping step. The device according to the invention advantageously provides a solution which will be described hereinafter.

Another significant feature of the invention provides for an auxiliary shaping step between the pre-shaping step and the final shaping step for bending only the ends of the U-shaped legs of the sheet bar to conform with the curvature of the second shaping chamber through relative displacement of the core into the second shaping chamber, without also bending the U-shaped legs disposed between these ends and the arched base of the U-shaped sheet bar blank. Consequently, this intermediate shaping step transforms the sheet bar blank into a stretched round profile, thereby promoting especially the precise rounding of the bushing ends.

Although the method according to the invention allows a highly accurate rounding of bushings, another embodiment of the invention provides a processing of the bushing in two working planes, with the pre-shaping, the intermediate shaping and the final shaping being assigned to the first working plane, and with the bushing being pushed axially into the second working plane after the final shaping for sizing there.

An important feature of the method according to the invention provides for an enlarged cross-section of the core by axially inserting an auxiliary core before the pre-shaping, thereby enabling at least one of the shaping dies to travel past the bushing center. This auxiliary core is advantageously employed after the final shaping step to push the bushing onto an expansion sleeve of the sizing station in the second working plane.

The invention relates furthermore to a bending device for carrying out the bending method, and this device is characterized in that the core and the first shaping chamber have a larger cross-section during the pre-shaping step than during the final shaping step. This feature can be implemented by interchanging the cores. Another alternate advantageous approach would be to employ an auxiliary core which is temporarily removed during the final shaping step. This auxiliary core preferably bears on the core with a concave surface and has a convex working surface which is complementary to the inner surface of the shaping chamber. Consequently, the auxiliary core has a sickle-shaped cross-section, with the working surface and the inner surface being positioned on circular cylinders of identical size.

The first shaping die preferably supports a slider displaceable in axial direction of the bushing and forming a part of the first shaping chamber, with the end face of the shaping chamber being formed on this slider and defining the partition plane of the shaping dies during the pre-forming and the intermediate or auxiliary forming steps. This partition plane is then positioned at a distance from the bushing center on the side of the first shaping die. The auxiliary core can now be advantageously combined with the slider into a conjointly movable unit so that the core and the first shaping chamber are provided with new cross-sectional configurations for the final shaping step of the bushing after this structural unit is retracted from the first working plane to thereby enable the unchanged second shaping die to travel past the bushing center for the final shaping step of the bushing.

Whereas conventionally, smaller sheet bars are suspended from a support tape centered above a rib, the sheet bars in the method according to the invention are secured to the support tape via two ribs located near the end sections of the sheet bar. Consequently, the sheet bar can be positioned more accurately inside the bending device. Since these ribs leave shear marks on the bushing face after separation from the support tape, the bushings produced in accordance with the invention differ from the state of the art in that the shear marks are located near the quarter girth adjacent to the bushing gap.

The three-step bending method with changing cross-sections of the core and shaping chambers results in a careful and very precise rounding of sheet bars, making the method according to the invention also suitable for extremely delicate laminated sheet bar materials.

The width of both shaping dies of the device according to the invention exhibit a width which is at least double the width of the bushing being bent and include in the axial direction next to their shaping chambers at least one respective sizing chamber, wherein both sizing chambers are mirror images of one another, have a same curvature as the curvature of the associated shaping chambers; but extend respectively only over a circumferential angle of 180°. Both sizing chambers form a circumferentially dosed sizing cavity in correspondence to the outer bushing envelope. This sizing cavity accommodates a spreader device, preferably in the form of a spreader sleeve, which can be expanded or contracted by means of an interior cone through axial displacement of an actuator rod.

This further development advantageously allows not only bending of a bushing with one and the same tool, but also sizing of the bushing in a second working plane by using this tool, thus obviating the need for repeatedly withdrawing and inserting the sheet bars and bushing blanks and the inaccuracies associated therewith.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 10:
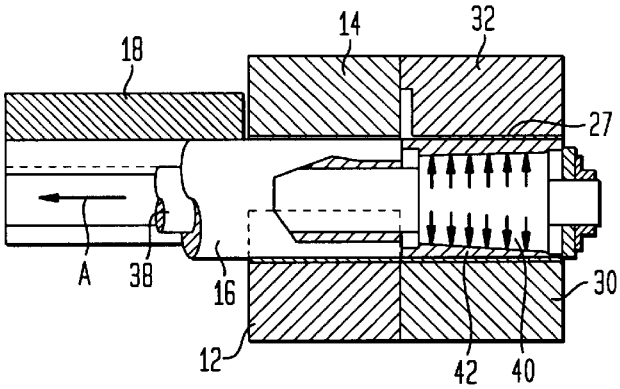

The figures schematically depict device parts of a bending device 10, comprised of a first shaping die 12, a second shaping die 14, a circular-cylindrical hollow core 16, an auxiliary core 18 and a slider 20 slideably supported on the first shaping die 12 for displacement in axial direction of the core 16. The auxiliary core 18 and the slider 20 form a unit which is moved back and forth in direction of the arrow A (FIG. 10) by a not shown actuating tool. The first shaping die 12 includes a shaping chamber 22 with a partly cylindrical bottom in the form of a section of a cylinder. In the region of the slider 20, the partly cylindrical inner surface of the shaping chamber 22 becomes semicylindrical and terminates with parallel inner surface sections at the end face plane 23 of the first shaping die 12.

The second shaping die 14 includes two die halves 14*a* and 14*b* conjointly forming a second shaping chamber 24. The second shaping chamber 24 is formed approximately as a mirror image of the shaping chamber 22 and has, aside from a step between the two die halves 14*a* and 14*b*, a semicylindrical profile with downwardly pointing parallel inner surface sections depending therefrom. The die part 14*a* is supported on the die part 14*b* for vertical displacement and is resiliently biased by a spring 15 (shown only schematically) against a stop on the die part 14*a* in such a way that a step 17 is created in the center plane of the shaping chamber 24.

Figure 1:
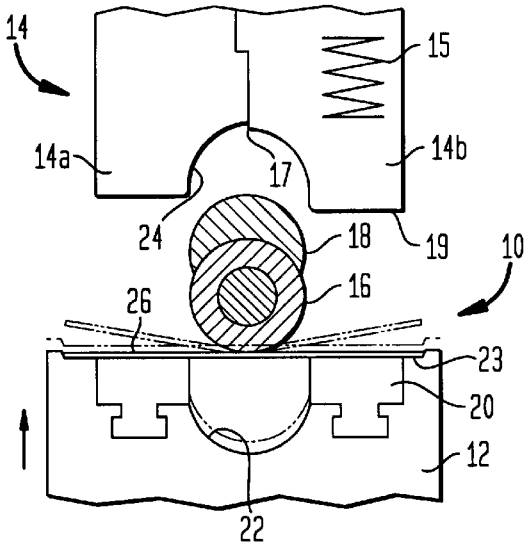
FIG. 1–FIG. 6 show the bending device with the sheet bar being bent in successive operating sequences.
Figure 2:
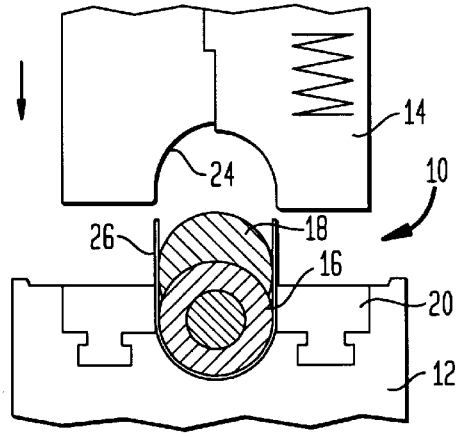

FIG. 1 shows the two shaping dies 12, 14 in spaced apart configuration. The core 16 is fixedly supported. A sheet bar 26 is inserted into the clearance between the core 16 and the end face of the first shaping die 12. The shaping die 12 then travels upwardly in the direction of the arrow as shown in FIG. 1 and bends the sheet bar 26 in the shape of a U, as shown in FIG. 2. The center of the core which coincides with the bushing center, is located below the face 23 of the first shaping die 12. Consequently, the core 16 has penetrated the shaping chamber 22 by a depth which is greater than the bushing radius. As a result, the 90° and 270° points of the bushing to be formed are located inside the shaping chamber 22, thereby preventing the formed U-legs of the sheet bar 26 from springing outwardly, but forcing them instead to sit close to the auxiliary core 18. This completes the pre-shaping process of the sheet bar 26.

Figure 3:
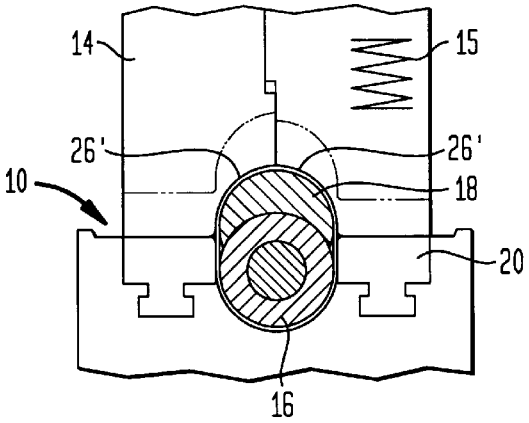
Figure 7:
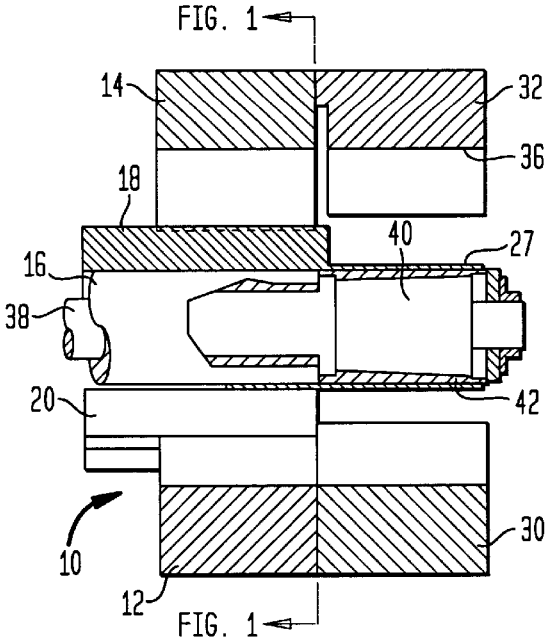
FIG.7–FIG. 12 show cross-sectional views of the bending device during the operating sequences corresponding to the respective views.
Figure 8:
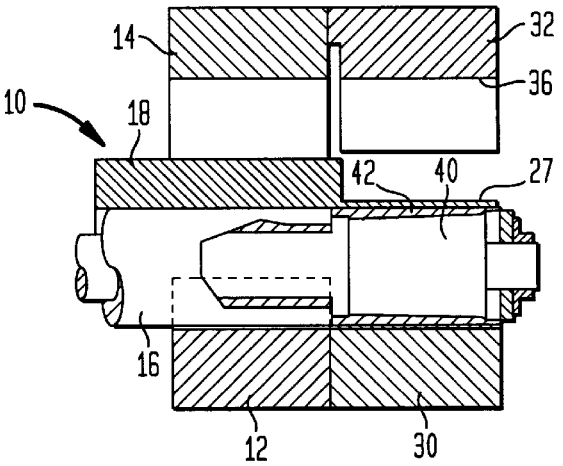
Figure 9:
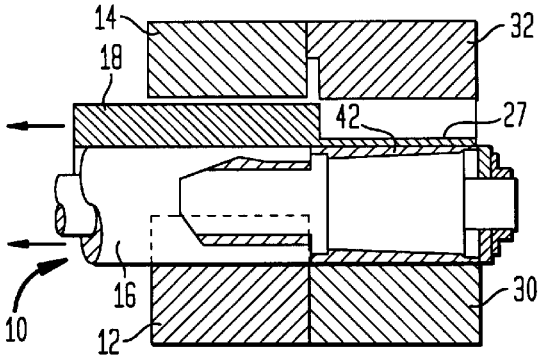

At this point, the second shaping die 14 moves downwardly, as shown in FIG. 3. The ends 26' of the U-legs of the sheet bar blank are bent inwardly upon touching the wall of the shaping chamber 24 and bear on the auxiliary core 18 when the auxiliary core 18 is placed on the shaping die 14. The rectilinearity of the U-legs of the sheet bar blank 26 is preserved in the region of the parallel sections of the chamber surfaces of both shaping dies 12, 14. The step 17 in the shaping chamber 24 causes the two leg ends 26' to be bent with a slight time delay. The bending step of the two leg ends 26' between the second shaping die 14 and the auxiliary core 18 represents an intervening auxiliary shaping step for shaping these leg ends 26' exactly as a circular cylinder and providing them already with their final shape.

At this point, the auxiliary core 18 together with the slider 20 is retracted between the shaping dies 12, 14 by axial movement in the direction of the arrow A (FIG. 10), with the second shaping die 14 being optionally slightly lifted. Subsequently, the second shaping die 14 travels downwardly again for providing the final shaping step of the bushing. After the slider 20 is pulled out of the first shaping die 12, the shaping die 14 can travel to a greater depth, beyond the end face 23 of the first shaping die 12, up to the bottom surface 28 of the shaping die 12, with the face 19 of the second shaping die 14 traveling downwardly beyond the center of the core, until the inner surface of the shaping chamber 24 bends the straight U-leg sections of the bushing blank likewise into a circularcylindrical shape, thereby completing the final shaping of the bushing 27.

The bushing ends are normally interlocked with each other by mutually engaging protrusions and cut-outs provided on the bushing ends. Since the die half 14*b* initially presses one of the bushing ends against the core 16, the form-fitting closing of the bushing 27 can be effected during the last phase of the downward movement of die half 14*a*. Both dies 12 and 14 subsequently separate (FIG. 5), allowing removal of the completed bushing 27 from the core 16.

FIGS. 7 to 12 illustrate an additional sizing process of bushing 27 performed in the same device 10 in a second working plane. For this purpose, tools 30, 32 are secured to the right side of both shaping dies 12, 14, with each tool being provided with a sizing chamber 34, 36 having the same curvature as the shaping chambers 22, 24, but spanning only over a circumferential angle of 180°. When the dies 12, 14 are dosed, the partition plane of the sizing chambers 34, 36 coincides with the center of the core. The hollow core 16 is penetrated by an actuator rod 38 supporting in the second working plane a cone 40 surrounded by a spreader sleeve 42.

Figure 4:
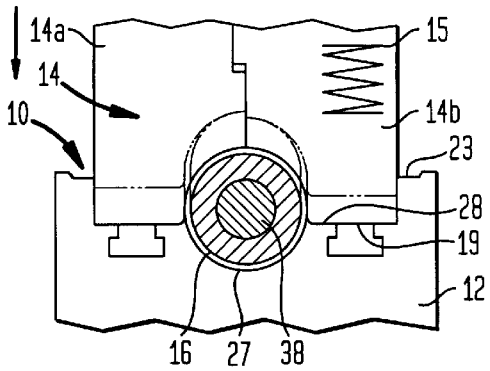
Figure 5:
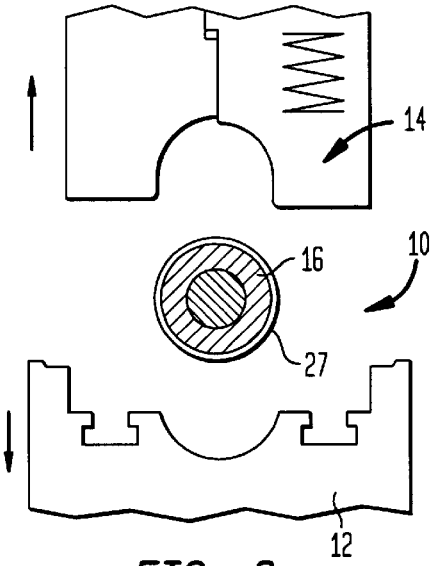
Figure 11:
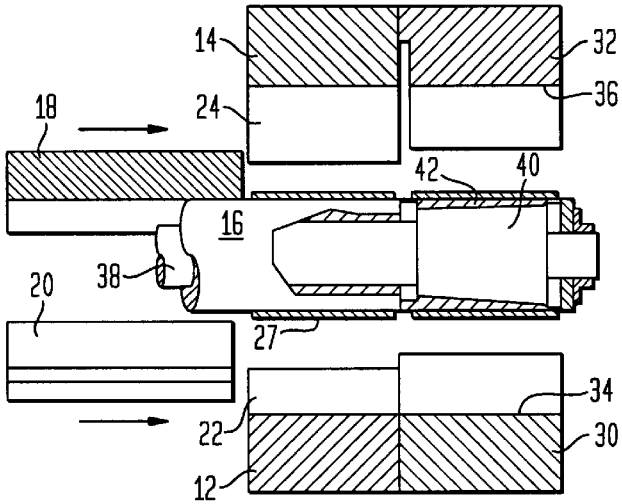
Figure 6:
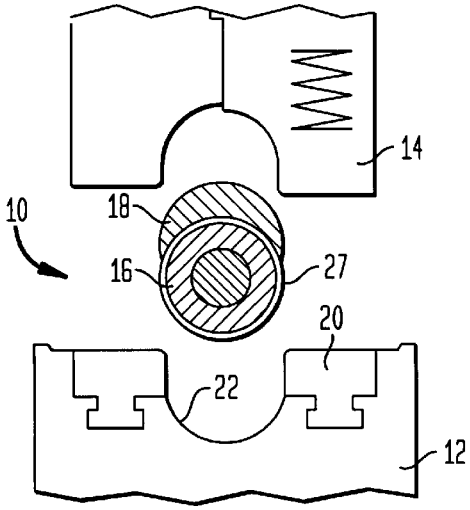
Figure 12:
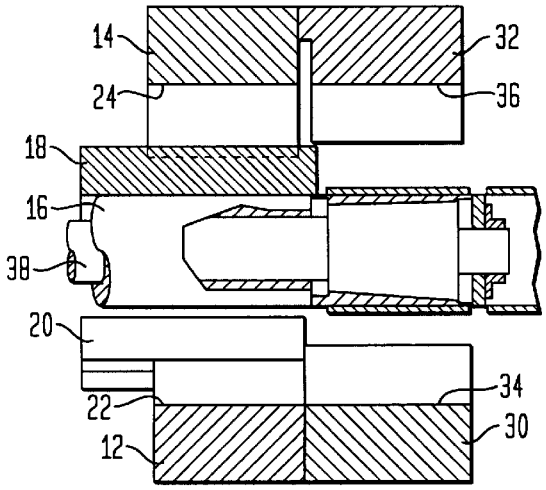

Taking into account FIGS. 5 and 11, the structural unit comprised of auxiliary core 18 and slider 20 moves again into the first working plane after the final shaping of bushing 27, with the auxiliary core 18 pushing the bushing 27 on the core 16 in the second working plane via the spreader sleeve 42. The bushing 27 which was sized during the previous processing cycle, is at the same time expelled from the device 10 (FIG. 12). The device 10 is now ready to accept a new sheet bar 26 in the first working plane. The processing steps of pre-shaping, intermediate shaping and final shaping of the bushing 27 are repeated, and the two tools 30, 32 are dosed in the position shown in FIGS. 4 and 10, forming a cylindrical sizing cavity enclosing the bushing 27. In this position, the actuator rod 38 is pulled in the direction of the arrow A (FIG. 10), thereby expanding the spreader sleeve 42 through the action of the cone 40 and sizing the bushing 27.

Consequently, the device 10 enables—without additional handling tools—highly accurate rounding and dosing of a sheet bar 26 in a first working plane and sizing in a second working plane.

While the invention has been illustrated and described as embodied in a method and device for rounding bushings, it is not intended to be limited to the details shown since various modifications and structural changes may be made without departing in any way from the spirit of the present invention.

What is claimed as new and desired to be protected by Letters Patent is set forth in the appended claims:

What is claimed is:

1. Method for rounding bushings between a core and a first shaping die having a shaping chamber and a second shaping die having a shaping chamber, comprising the steps of pre-shaping the bushing by inserting a sheet bar blank into a clearance between the core complementing an inner profile of the bushing and an end face of the first shaping die of a multi-part shaping chamber with one part of the chamber having an inner profile complementing the outer profile of the bushing and with an other part thereof enlarging the height of the shaping chamber; bending the sheet bar into a pre-shaped bushing approximately in the shape of a U with two leg sections through a relative movement of the core by which the core is penetrating into the first shaping chamber to a depth which is greater than a radius of the pre-shaped bushing and each of the U-leg sections extending rectilinearly from the shaping chamber; during an auxiliary shaping step extending an auxiliary core in the direction of the U-legs of the pre-shaped bushing and thus enlarging a cross section of the core; bending adjacent ends of the U-leg sections inwardly against the enlarged core through relative vertical movement of the legs of the pre-formed bushing together with the enlarged core into the second shaping chamber also being complementary to the outer profile of the bushing thereby effecting the leg ends bearing against the auxiliary core in correspondence with a contour of the second shaping chamber but without simultaneously bending the leg sections during the auxiliary shaping step; during a final shaping step, removing the auxiliary core and moving the second shaping die through relative vertical displacement and shaping both of the U-leg sections into a bushing.

2. Method according to claim 1, wherein during the final shaping of the bushing, the core is penetrating the second shaping chamber to a depth greater than the bushing radius so that after the final shaping step of the bushing, a bushing axis lies at a distance from an end face plane of the second shaping die within the shaping chamber thereof.

3. Method according to claim 1, wherein the enlargement of the bushing-complementary core is effected through axial insertion of an auxiliary core.

4. Method according to claim 3, wherein bending the two leg ends starts at a slight delay.

5. Method according to claim 1, wherein at least the pre-shaping step and the final shaping step of the bushing (27) are carried out in a first working plane and subsequently pushing the bushing axially into a second working plane for sizing.

6. Method according to claim 5, wherein after the final shaping step, the bushing is pushed by the auxiliary core (18) into the second working plane and onto a spreader sleeve (42) of a sizing station.

7. Method according to claim 1, wherein during the step of pre-shaping, and after closing both shaping chambers, their complementary contour corresponds to the outside profile of the cross-sectionally enlarged core (16, 18).

8. A device for rounding bushings comprising, a lower shaping die having a multi-part shaping chamber having one part with an inner profile complementing an outer contour of a bushing and another part for enlarging the height of the shaping chamber;

an upper shaping die having a shaping chamber with a contour corresponding to the outer contour of the bushing;

a first core having a contour corresponding to an inner contour of the bushing;

an auxiliary core for enlarging a cross section of the core; wherein a pre-shaped bushing is formed by placement of a sheet blank between the core and the lower shaping chamber such that the core can penetrate the first shaping chamber to a depth which is greater than a radius of the bushing and the sheet blank is bend approximately into a U-shape with two leg sections extending rectilinearly, and wherein the auxiliary core is disposed relative to the upper shaping chamber in such a manner that through relative vertical movement of the leg ends adjacent to the U-leg sections into the upper shaping chamber, the leg ends bear against the auxiliary core thereby reducing the distance of the leg ends to each other prior to the U-leg sections being bent into a circular cylinder of the bushing.

9. Device according to claim 8, wherein the first shaping die (12) supports a slider (20) slideable in axial direction of the bushing and forming part of the first shaping chamber (22), and that a partition plane of the first shaping die (12) which includes the slider (20) extends on the side of the second shaping die at a distance from a bushing center.

10. Device according to claim 8, wherein the auxiliary core (18) is provided with a concave surface for bearing on the core (16) and a convex working surface which complements the inner surface of the shaping chamber of the second shaping die (14).

11. Device according to claim 8, wherein the multi-part shaping chamber includes a slider for forming a movable unit in conjunction with the auxiliary core.

12. Device according to claim 8, wherein the second shaping die (14) includes two halves (14*a*, 14*b*), with a first half associated with the shaping chamber and movably supported on a driven half (14*b*) in direction of die movement and biased by a spring force in an initial position which is offset with respect to the first die half (14*a*) so as to form a step (17) in the shaping chamber (24) at the location where the leg ends of the bushing are interlocked.

13. Device according to claim 8, wherein both shaping dies (12, 14) have a width which is at least twice the width of the bushing (27) and include axially next to each of their shaping chambers (22, 24) a sizing chamber (34, 36) each having a same curvature their respectively associated shaping chambers (22, 24) and extending only at a circumferential angle of 180°, whereby a sizing cavity is formed, and wherein a spreader device is disposed inside the sizing cavity for sizing the bushing.

14. Device according to claim 13, wherein the core (16) is hollow and is traversed by an axially moveable actuator rod (38) which has a cone (40) in the area of the sizing cavity for cooperation with an inner cone of a spreader sleeve (42).

* * * * *